US005779168A

United States Patent [19]

Meltzer

[11] Patent Number: 5,779,168

[45] Date of Patent: Jul. 14, 1998

[54] REFINER AND TOOLING FOR REFINING SUSPENDED FIBROUS MATERIAL

[75] Inventor: Frank Meltzer, Daisendorf, Germany

[73] Assignee: Voith Sulzer Stoffaufbereitung GmbH, Ravensburg, Germany

[21] Appl. No.: 610,117

[22] Filed: Feb. 29, 1996

[30] Foreign Application Priority Data

Mar. 8, 1995 [DE] Germany ..... 195 08 202.8

[51] Int. Cl.[6] ..... B02C 7/12

[52] U.S. Cl. ..... 241/261.1; 241/261.2; 241/298; 241/294

[58] Field of Search ..... 241/261.1, 261.2, 241/261.3, 296, 297, 298, 293, 294

[56] References Cited

U.S. PATENT DOCUMENTS

| | | | |
|---|---|---|---|
| 2,654,295 | 10/1953 | Sutherland | 241/261.3 X |
| 4,813,621 | 3/1989 | Kleinhans | 241/261.2 |
| 5,200,038 | 4/1993 | Brown . | |

FOREIGN PATENT DOCUMENTS

| | | | |
|---|---|---|---|
| 25 22 349 | 4/1975 | Germany . | |
| 26 09 727 | 9/1976 | Germany . | |
| 35468 | 12/1953 | Poland | 241/261.2 |
| 230916 | 5/1980 | U.S.S.R. | 241/261.3 |
| 1390281 | 4/1988 | U.S.S.R. | 241/261.2 |

*Primary Examiner*—Mark Rosenbaum
*Attorney, Agent, or Firm*—Taylor & Associates, P.C.

[57] ABSTRACT

The invention is directed to a refiner and refiner tooling for economical refining of suspended fibrous material where the radial expanse of the working surfaces (7, 8) deviates from known designs in the following manner: the elevations (10, 11) forming the working surfaces, notably cutters, are several times interrupted, thereby forming grooves (16). It is possible to arrange the shorter cutters (10, 11) on the stator (3) side, on the rotor (2) side, or on both sides. These measures result in a particularly economical and uniform refining.

14 Claims, 2 Drawing Sheets

Fig.1
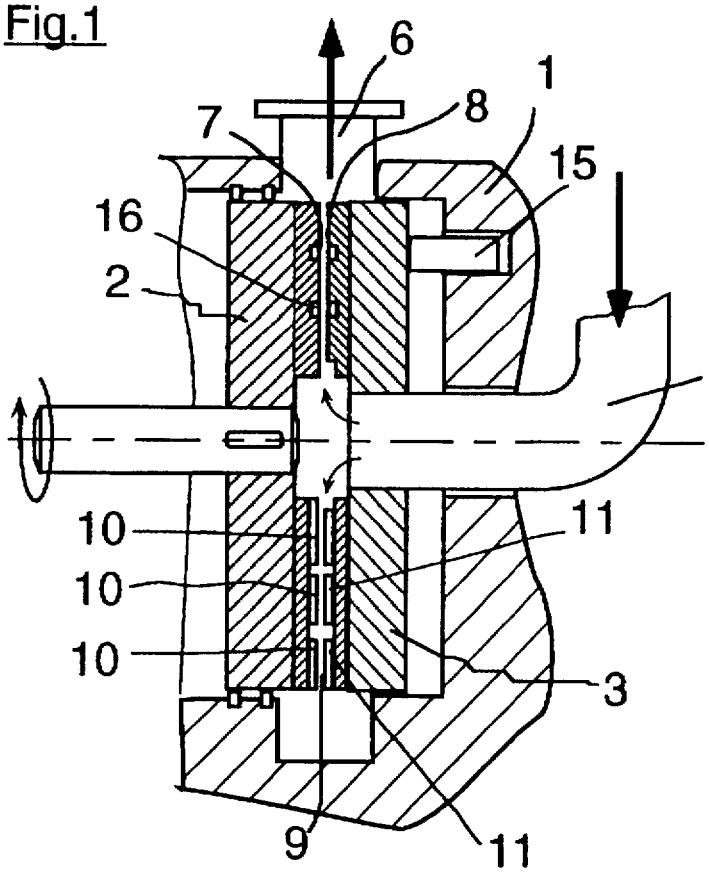
Fig.2
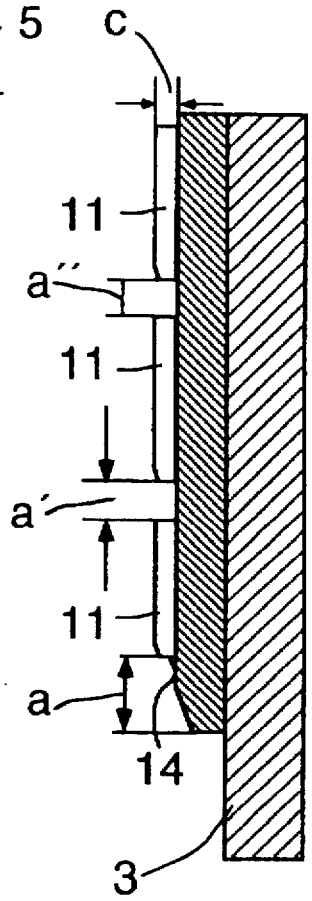
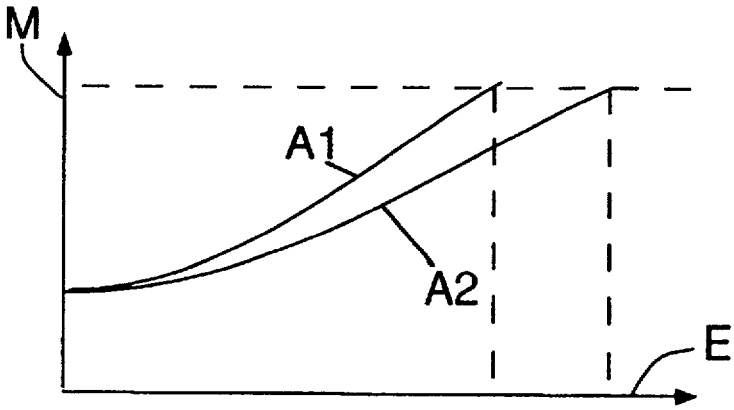
Fig.3
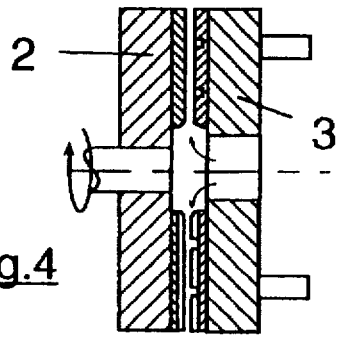
Fig.4
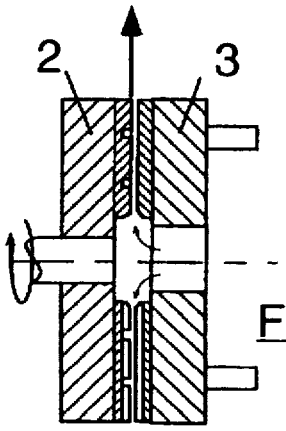
Fig.5

REFINER AND TOOLING FOR REFINING SUSPENDED FIBROUS MATERIAL

BACKGROUND OF THE INVENTION

1. Field of the Invention

The present invention relates to a device for refining suspended fibrous material.

2. Description of the Related Art

Often also called tooling set, refiner tooling of the said type is installed in so-called refiners. These have at least one rotor and at least one stator with either disk-shaped or truncated-cone-shaped surfaces on which the tooling is arranged in a way allowing for the formation of refining gaps. The tooling reviewed here features ridges and grooves on its working surfaces, for which reason it is referred to also as "cutter set." A ring-shaped refining surface is in technical practice often created by assembling a number of identical circular segments until a full circular circumference is obtained with a center common to all of the segments.

A considerable part of the operating costs involved in refining fibrous stock in the pulp and paper industry are attributable to energy costs. Therefore, efforts have been made to build and operate such devices in a way such that—measured on the desired result—energy consumption remains acceptable. The objective in the treatment of fibrous stock differing dependent on application, the assessment of the refining effect differs as well. Energy consumption is in many cases related to the refining result, stating as magnitude either per ton of fiber stock and increase in refining degree or kilowatt hours per ton of fiber stock and increase in strength. But the comparability of such values requires otherwise same conditions. Not possible, in particular, is reducing refining costs in that, while consuming less energy, the treated fiber stock fails on the other hand—despite sufficient increase in degree of refining—to meet quality requirements.

A refining tool intended for refining wood pulp is illustrated in DE-OS 25 22 349. It is a cutter set with a specific inner circular section serving the breakup of the inflowing wood pulp, and not the change of the fibers themselves that is intended in refining. The refiner system shown in DE-OS 26 09 727 is primarily geared also to the requirements applicable to mechanical wood pulp. Therefore, the refining zone proper is preceded by an inner "refining zone" in which the fiber material is disintegrated nearly down to the individual fiber. The actual refining of the fibers takes place only thereafter, in the radially outer refining zone. Further still in the direction of subdividing the processing zones within a machine is the disclosure of U.S. Pat. No. 5,200,038, where two rotors provided with different drives are equipped with very specific tooling. The inflowing stock (pulp) is again passed first to a prezone, which here acts only as a fluidizing zone.

Despite these efforts at improving refiners for fibrous paper stock, still further reductions of the required refining energy consumption continue to be desired.

SUMMARY OF THE INVENTION

An advantage of the refiner of the present invention is that the energy consumed for refining, for a desired refining result, is lower than heretofore.

Created by the invention are refining devices where the energy consumed can be utilized better for refining the fiber material. It has been demonstrated that not only the increase in refinement can be achieved more economically, but that the refining also allows a relatively good retention of the fiber length and fiber strength. The assessment of the effect, as mentioned before, will always need to be based on the refining developments achievable before, for which reason it is unsuitable to present here more generally a fixed figure value. At any rate, studies of the present invention evidence a significant reduction of the required energy, without having to accept impairments in fiber quality.

A substantial innovation as compared to the prior art is constituted by an improved flow in the gap between rotor and stator flooded by the fiber stock suspension in the operation of the refining device. The fibers are altered in the area of the working surfaces of the rotor and stator by strong forces, with an only very slight spacing being set between the working surfaces in the refining operation. Since on the working surface so defined there are several slats located successively, viewed in the direction of the channels, that have each a spacing of at least 8 mm, and preferably approximately between 8 and 30 mm, several intermediate zones are created there inventionally, in which the suspension stemming from the preceding refining area can be received and then passed on to the following refining area. Each such intermediate zone has presumably a double benefit, since it promotes both the desirable partial recycling of the already refined suspension to the previous refining area and also the smoothing of the flow in the following refining area. This allows improving the refining result, notably making the refining more uniform. Such intermediate zones can be created by grooves of, e.g., annular shape. Especially favorable are also polygonal grooves, because the refining tooling wear, sometimes somewhat critical, is reduced in the grooved area.

In special cases, a specific area with slats can be additionally created through which passes the suspension before entering the refining area of the refiner, or refiner tooling reviewed here. Thus, before or while the suspension enters the cutter area of the refining device, a zone of rotation is made available which borders on a rotating surface, but which has no ridges on at least one side. No refining takes place in this annular zone. A possible reason for the further improvement in economy could be the smoothing of the suspension flow upon entering the refining zone. The annular zone can be formed by configuration of the refiner proper or in the radially inner zone of the refiner tooling itself.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 1 is a cross-sectional side elevation of an inventional disk refiner;

FIG. 2 is a section of FIG. 1;

FIG. 3 is a diagram of the refining development;

FIGS. 4–6 are further embodiments of the refining tooling;

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 7:
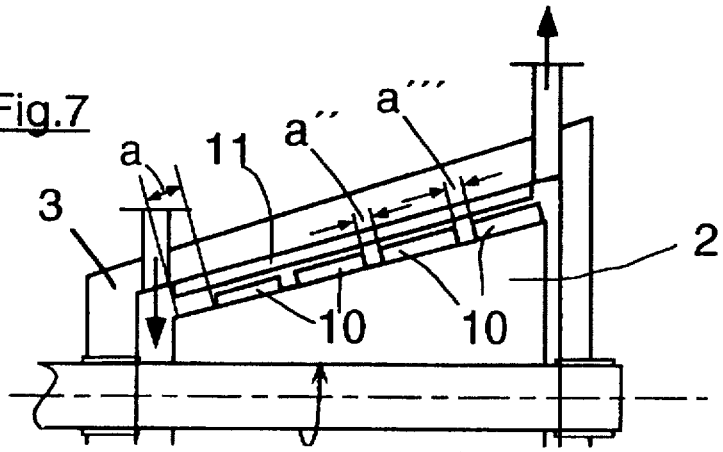
FIG. 7 is an inventional conic refiner.

FIG. 1 shows one embodiment of a refiner of the invention in the form of a disk refiner. Visible is part of the housing 1, rotor 2 and stator 3, with rotor 2 and stator 3 serving as tooling supports. The suspended fiber stock can be supplied through inlet port 5 and removed via outlet port 6. In the form depicted here, rotor 2 is axially fixed while stator 3 is axially movable relative to rotor 2, with bolt 15 preventing the rotor from being entrained. Rotor 2 has a working surface 7 and stator 3 has a complementary working surface 8. Formed between the two working surfaces 7, 8 is a refining gap 9, which here and in the further figures is shown exaggerated in width. Contained in the area of working surfaces 7, 8 are slat-shaped elevations 10 on the rotor 2 and slat-shaped elevations 11 on the stator 3. The presentation here is such that the slat-shaped elevations 10, 11 are shown, in the upper part, sectionally and in the bottom part solid. As can be seen, three slat-shaped elevations 10 and 11 each are arranged on both sides of the refining gap 9 radially successively, i.e., interrupted by grooves 16. Further, they extend a lesser distance inward on the stator side than they do on the rotor 2.

FIG. 2 is a sectional view through FIG. 1, showing part of stator 3. Recognizable between the slat-shaped elevations 11 are the voids a' and a" as well as void a, by which the base area 14 of the refiner tooling extends radially inward farther than elevation 11. Elevations 11 have a radial expanse between voids a, a', a" and a height dimension c above the base surface 14. Voids a, a' and a" each measure approximately between 8 and 30 mm in a direction transverse to the direction of relative movement between rotor 2 and stator 3. Height dimension C may be, e.g., between 2 and 20 mm.

FIG. 3 shows schematically a diagram depicting the refining development M dependent on the refining energy E used. According to the prior art, the refining development follows curve A2, whereas a faster refining development, curve A1, is achieved with the aid of the present invention. Of course, the quantitative values depend heavily on the stock used, and the diagram merely serves to illustrate the achievable benefit.

Figure 6:
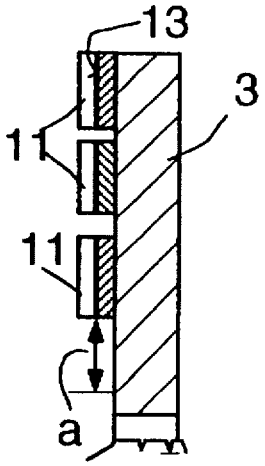

FIGS. 4 and 5 are basic sketches showing further embodiments of a disk refiner. The interruptions of the slats by grooves may be on the stator side (FIG. 4), on the rotor side (FIG. 5) or—as shown already in FIG. 1—on both sides. The embodiment of FIG. 6 differs from that relative to FIG. 2 in that not only the actual slat 11 features interruptions by grooves, but also the refiner tooling itself mounted on stator 3. Of course, the principle of FIG. 6 can be applied also with other combinations according to FIGS. 1, 4 or 5.

Although the application of the invention certainly is particularly suitable to refiners equipped with disks or to the pertaining refiner tooling, advantages can be achieved also with conic refiners, or jordans, notably adjustable jordans.

FIG. 7 shows a jordan where the elevations 10 located on the working surface of rotor 2 are interrupted by grooves. Unlike the illustration here, also the stator 3 may in other cases have elevations 11 with interruptions. Voids a, a" and a'" each measure approximately between 8 and 30 mm in the directions indicated by the arrows, transverse to the direction of relative movement between rotor 2 and stator 3.

Figure 8:
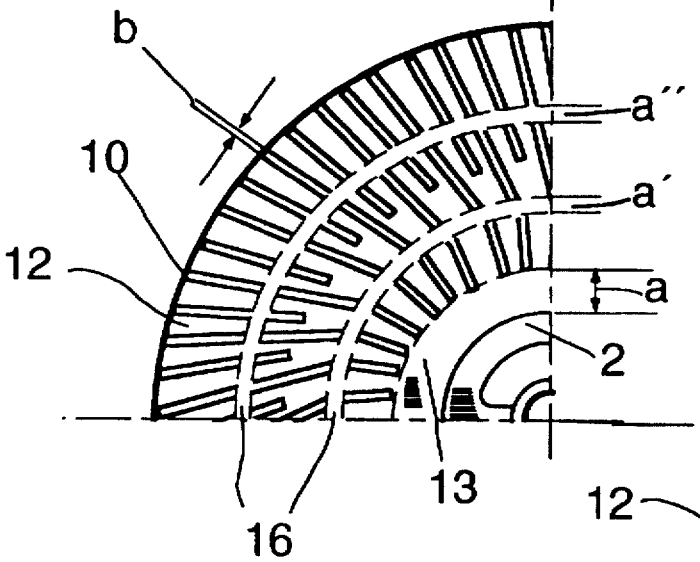
FIG. 8 is a plan view (segment) of an inventional refiner tooling.

FIG. 8 shows a plan view of a typical working surface as found on disk refiners, with a plurality of—here fashioned differently—elevations 10 of width b and the interposed channel type grooves 12. Also shown are grooves 16, and at that, annular grooves with the voids a', a". Besides, the elevations 10 are here inwardly shorter than the base surface 13 by the void a. This illustration is to be understood as a part, or segment, of the entire circular circumference. As known, the complementary working surface has in terms of elevations mostly the same pattern, with that expressed already in conjunction with FIGS. 1 and 4–6 applying also to the presence of the voids a, a', a". The complementary working surface may also be designed entirely differently, featuring, e.g., other cutter angles, being porous at the surface or have a knobby or perforated pattern.

Elevations 10, 11 may have, e.g., a maximum radial expanse of approximately 100 mm, or a maximum radial expanse of 60 mm, or a maximum radial expanse of approximately twenty times width b.

Figure 9:
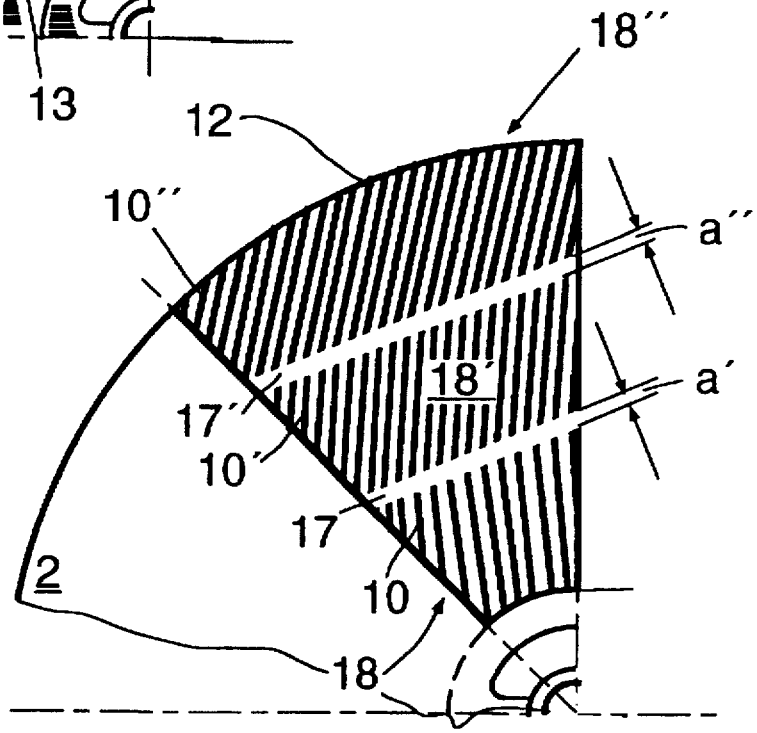
FIG. 9 is a plan view (segment) of a further inventional refiner tooling.

The refiner tooling according to FIG. 9 resembles that of FIG. 8, but has two polygonal recesses 17, thereby creating three successive refining areas 18, 18' and 18". Depicted here is only one of the 45°-segments, of which a circular set can be assembled.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A refiner for refining suspended fibrous material, said refiner including a housing having an inlet port and and outlet port for the suspended fibrous material; at least two refiner tooling supports; and refiner tooling carried by said at least two refiner tooling supports, said refiner tooling defining a working surface carried by one of said at least two refiner tooling supports and a complementary working surface carried by an other of said at least two refiner tooling supports, said working surface and said complimentary working surface being movable relative to each other, said working surface and said complimentary working surface being positioned relative to each other so as to form a refiner gap therebetween for receiving the suspended fibrous material, at least one of said working surface and said complimentary surface including a plurality of slat-shaped elevations defining channel type grooves therebetween, wherein the suspended fibrous material can be at least partly carried by said channel type grooves and a mechanical working of the suspended fibrous material can take place by the relative movement between said working surface and said complementary working surface, the improvement comprising:

said plurality of slat shaped elevations having a maximum radial expanse of approximately 60 millimeters and including at least three slat-shaped elevations arranged successively in the direction of said channel type grooves (12), said at least three slat-shaped elevations having a void (a', a", a'") of approximately 8 and 30 millimeters therebetween in a direction transverse to the direction of relative movement between said working surface and said complementary working surface, said slat-shaped elevations of at least one of said working surface and said complimentary working surface being disposed a distance of a void (a) of approximately between 8 and 10 mm from a radially inward edge of a corresponding said refiner tooling support.

2. The refiner according to claim 1, wherein said at least two refiner tooling supports comprise two disk-shaped tooling supports.

3. The refiner according to claim 1, wherein said at least two refiner tooling supports comprise two frustroconical-shaped tooling supports.

4. Refiner tooling for use in a refiner for refining suspended fibrous material; the refiner including at least two refiner tooling supports which relative to each other are movable, mutually opposed and essentially rotationally symmetric; said refiner tooling defining at least one pair of complementary working surfaces respectively carried by said refiner tooling supports, said working surfaces being movable relative to each other and positioned relative to each other so as to form a refiner gap therebetween for receiving the suspended fibrous material, at least one of said working surfaces including a plurality of slat-shaped elevations adjacent said refiner gap, and slat-shaped elevations defining channel type grooves therebetween, wherein the suspended fibrous material can be at least partly carried by said channel type grooves and a mechanical working of the suspended fibrous material can take place by the relative movement between said working surfaces, the improvement comprising:

said plurality of slat shaped elevations having a maximum radial expanse of approximately 60 millimeters and including at least three slat-shaped elevations arranged successively in the direction of said channel type grooves (12), said at least three slat-shaped elevations having a void (a', a", a'") of approximately between 8 and 30 millimeters therebetween in a direction transverse to the direction of relative movement between said working surfaces, said slat-shaped elevations of at least one of said working surfaces being disposed a distance of a void (a) of approximately between 8 and 30 mm from a radially inward edge of a corresponding said refiner tooling support.

5. The refiner tooling according to claim 4, wherein said slat-shaped elevations have a width (b) and a maximum radial expanse of approximately twenty times said width (b).

6. The refiner tooling according to claim 4, wherein said refiner tooling includes a based surface having one of a substantially circular shape and a circular segment shape.

7. The refiner tooling according to claim 6, wherein said slat-shaped elevations have a height above said base surface of approximately between 2 and 20 millimeters.

8. The refiner tooling according to claim 7, wherein said slat-shaped elevations have a height above said base surface of approximately between 2 and 8 millimeters.

9. The refiner tooling according to claim 8, wherein said void extends substantially circularly around a center of said base surface and has approximately the same height as said slat-shaped elevations.

10. The refiner tooling according to claim 8, wherein said void extends substantially polygonally and symmetrically to a center of said base surface and has approximately the same height as said slat-shaped elevations.

11. The refiner tooling according to claim 4, wherein said refiner tooling includes a base surface having a substantially frustroconical shape.

12. The refiner tooling according to claim 11, wherein said void extends substantially circularly and symmetrically about the center line of said frustroconical shaped base surface and has approximately the same height as said slat-shaped elevations.

13. The refiner tooling according to claim 4, wherein said slat-shaped elevations have a width (b) of approximately between 2 and 30 millimeters.

14. The refiner tooling according to claim 4, wherein said channel type grooves have a width of approximately between 3 and 20 millimeters.

* * * * *

UNITED STATES PATENT AND TRADEMARK OFFICE

CERTIFICATE OF CORRECTION

PATENT NO. : 5,779,168
DATED : Jul. 14, 1998
INVENTOR(S) : Frank Meltzer

It is certified that error appears in the above-identified patent and that said Letters Patent is hereby corrected as shown below:

Column 4

Line 37, delete "and" and substitute --an-- therefor; and
Line 63, after "approximately" add --between--.

Column 5

Line 3, delete "10" and substitute --30-- therefor.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*